United States Patent [19]

Dietrich

[11] 4,048,600

[45] Sept. 13, 1977

[54] CONTACT SYSTEM FOR RELAYS, PARTICULARLY POWER RELAYS

[75] Inventor: Bernhard Dietrich, Eichenau, Germany

[73] Assignee: Schaltbau Gesellschaft MBH., Munich, Germany

[21] Appl. No.: 631,745

[22] Filed: Nov. 13, 1975

[51] Int. Cl.[2] ..... H01H 67/02

[52] U.S. Cl. ..... 335/128; 335/201; 200/244

[58] Field of Search ..... 200/16 A, 16 R, 16 S, 200/244; 335/106, 107, 112, 128, 131, 133, 193, 196, 111, 275, 132, 200, 201, 339, 307, 317

[56] References Cited

U.S. PATENT DOCUMENTS

| | | | |
|---|---|---|---|
| 2,841,670 | 7/1958 | Peter | 335/131 X |
| 3,155,790 | 11/1964 | Lemonnier | 335/200 X |
| 3,451,019 | 6/1969 | Auer et al. | 335/201 |

*Primary Examiner*—George Harris
*Attorney, Agent, or Firm*—Ralf H. Siegemund

[57] ABSTRACT

A relay has the contacts arranged in that two pairs of contacts on the armature are arranged so that the contacts of one pair extend at right angles, to the contacts of the other pair, but parallel to a hinge axis. Insulative partitions separate the contacts of the former pair individually from the contacts of the latter pair. Magnetic blower is provided for arc extinguishing.

13 Claims, 3 Drawing Figures

FIG. 1
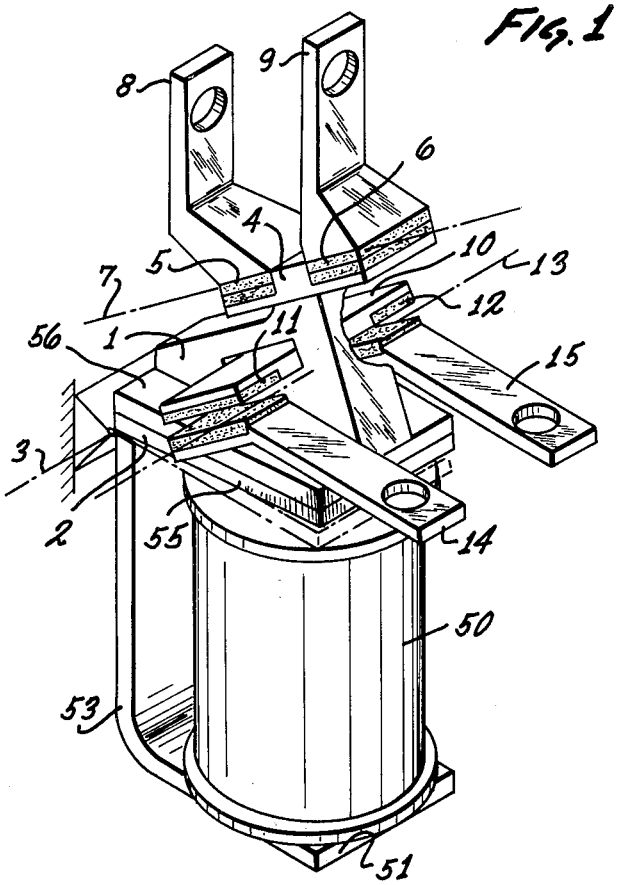
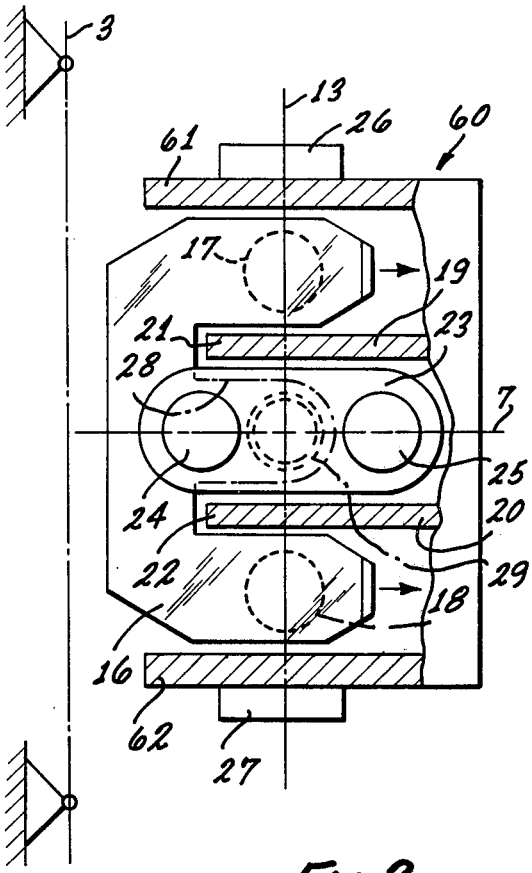
FIG. 2
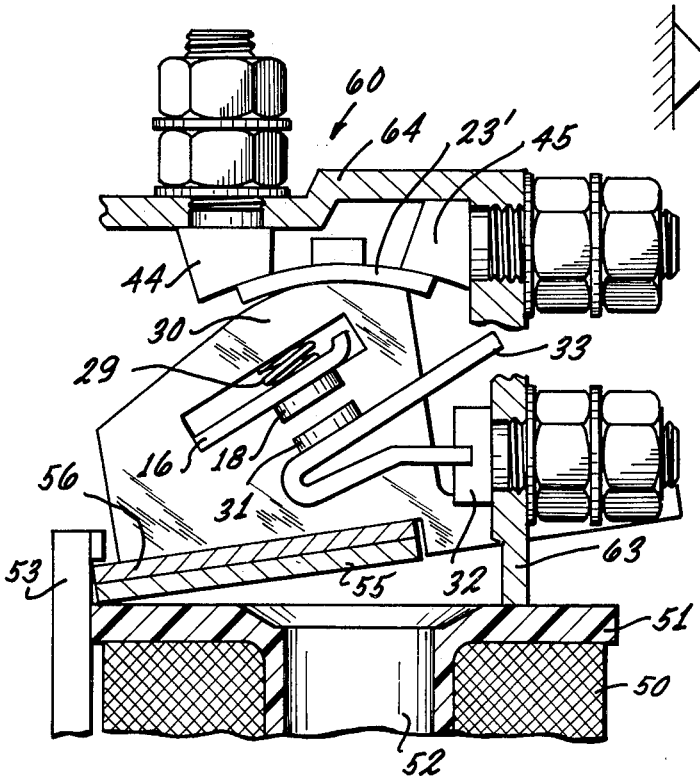
FIG. 3

CONTACT SYSTEM FOR RELAYS, PARTICULARLY POWER RELAYS

BACKGROUND OF THE INVENTION

The present invention relates to construction features of an armature for power relays and more particularly the invention relates to a contact system on such an armature constituting the, or one of the, movable contact or contacts of the relays.

Power relays are known wherein the contact or contacts on the armature makes contact in the energized as well as in the unenergized state, of course, with different sets of contacts in each instance. A typical power relay of this type is traded for example under the designation S 167 by the assignee of this application for patent. One of the limitations of this known relay as far as its performance is concerned, is to be seen in that for power above a certain level the following may happen. An arc may, for example, on de-energization of the relay between a movable contact and a stationary contact with which the movable contact had made contact in the energized state and from which it now recedes, jump to another stationary contact, e.g. to one which another movable relay contact on the armature is about to engage, resulting in a short circuit which may even feed the continuation of that arc, thereby burning off the two stationary contacts.

DESCRIPTION OF THE INVENTION

It is an object of the present invention to provide for a contact system on an armature, preferably as pertaining to a power relay and which carries contacts for contact making with stationary contact in the energized state and with other contacts in the unenergized state and in which arcing in-between the stationary contacts is greatly impeded.

It is a specific object of the present invention to improve the contact system of relays, wherein operative connections are made through twin contact facilities for an energized as well as for an unenergized relay state.

In accordance with the preferred embodiment of the invention, it is suggested to provide the contacts of one pair on the armature in spaced apart relation along one line which extends at right angles to a line along which the contacts of a second pair on the armature are spaced, and wherein each of these lines extend at right angles to the effective direction of contact movement in each instance of contact opening. The contacts of one pair make contact with stationary contacts when the relay is energized, and the contacts of the other pair make contact with other stationary contacts when the relay is de-energized. If the relay is constructed with a pivotable or rocking armature, the axis of pivot motion extends parallel to one of the contact pair lines and, preferably, that latter contact pair is the one through which flows the heavier current e.g. for an energized relay state.

Preferably, the contact paths of the contacts switching the heavier current are insulatively shielded by means of partitions which extend respectively to the side of each contact of that particular pair and to the contacts of the other pair.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings, in which:

FIG. 1 is an isometric view of a first example of the preferred embodiment of the invention;

FIG. 2 is a top section view of a modified example, and

FIG. 3 is a side section view of a still further modified example.

Proceeding now to the detailed description of the drawings, the Figures show relays each having a coil 50 on a tubular coil carrier 51 made of insulating material and receiving a core 52 (FIG. 3). An L-shaped yoke 53 is affixed to the rear or bottom end of the core in the coil carrier and extends alongside the coil 50 to define a hinge or pivot axis 3 for an armature plate 55 made of soft iron. The plate 55 is affixed to an insulative carrier plate 56. The hinge connection is schematically shown in FIGS. 1 and 2; a more detailed configuration is shown in FIG. 3, illustrating the two plates 55/56 as being hinged by means of projections at the end of yoke 53; plate 55 has its one edge resting on coil carrier 51.

Turning now to specifics of FIG. 1, there is shown an armature body 1 made of insulating material to which is affixed plate 56. Armature 1 carries in addition two contact bridges, one of them designated by reference numeral 4, the other one by numeral 10.

Contact bridge 4 is mounted on top of armature body 1 and carries two contacts 5 and 6 which are arranged along an axis 7, i.e. the centers of the two contacts are aligned along that axis 7 which extends transversely to axis 3, without intersection between these axes. The two contacts 5 and 6 respectively cooperate with contacts on stationary contact carriers 8 and 9, whereby particularly the contacts close in pairs for de-energized relay for current flow from one carrier to the other, across the contacts and through the bridge 4. The contacts 5, 6 move in a direction relative to contacts 8, 9 which extends transversely to the axis 7.

The bridge 10 carrier on its underside two contacts 11 and 12. These contacts are arranged as to their centers along an axis 13 which runs parallel to axis 3, so that by necessity axes 7 and 13 extends at right angles, but again without intersection. The two contacts 11 and 12 respectively cooperate with contacts on stationary carriers 14 and 15 and the contacts are closed in pairs for energized relay. The direction of movement following opening or immediately preceding closing of the contacts extends also here transverse to the contact axis 13.

It can thus be seen that the contact pairs for different energizing states of the relay are oriented along different axes. If one assumes that heavy duty current flows through contact carriers 14 and 15 and across the bridge 10, an arc forms e.g. between contact 11 and the contact or carrier 14; another arc forms or may form between contact 12 and the contact on carrier 15. These arcs are offset from either of the contacts on carrier or bridge 4 so that jumping of the arcs to that bridge or to any of the stationary contacts and carriers 8, 9 is significantly impeded.

It can readily be seen that the construction principle as far as the orientation of the contacts is concerned is rather independent from the hinge feature of the armature. One could employ the same principle also for longitudinally displaced armatures. However, a pivot armature is more economical to make.

FIGS. 2 and 3 show an improvement which provides for even greater protection against forbidden arc jumps. The armature body 30 carries a first contact bridge 23 (FIG. 2) with contacts 24 and 25 which essentially correspond to contacts 5 and 6. The modification depicted in FIG. 3 shows a single contact plate 23' bolted to armature 30. The contact making areas on plate 23' are operationally defined by the two cooperating counter contacts 44 and 45 and arranged along a line, so that the contact making areas of plate 23' are also arranged along a line, which extends transversely to the direction of contact movement. One can also say that the contact making areas on bridge 23' have centers which are aligned on an axis and this axis extends transversely to the hinge axis as well as to the direction of contact bridge movement.

The second bridge is the same in both figures and is denoted here with reference numeral 16; it is of E-shaped configuration. The center leg 28 of the E is disposed in a slot in armature 30 and held therein by means of a spring 29. The outer legs carry contacts 17 and 18 for contact making with stationary contacts only one of which, 31, being visible in FIG. 3. The contact 31 is mounted on a resilient contact carrier 33.

The contact arrangement and armature is contained in a casing 60 with side walls 61 and 62 (FIG. 2) and a front wall 63 which continues in a top 64. Contact 44 is bolted to the top 64, while contact 45 is bolted to the upper portion of front wall 63. In addition, the casing includes two partitions 19 and 20 respectively projecting into the spaces between the legs of the E. Actually, these partitions may extend all the way to the casing wall opposite to wall 63 and have apertures 21, 22 through which passes the stem portion of the E of bridge 16 with sufficient clearance to permit up and down movement of the bridge corresponding to armature displacement.

Essential in the construction of FIGS. 2 and 3 is that the partitions are interposed between the contacts 17 and 18 on the one hand and the contacts 24, 25 on the other hand (or contact plate 23') to reduce further the probability of arc jumping between the several stationary contacts of the system.

This particular example is additionally provided with means for magnetically blowing the areas to ensure rapid extinction. As shown in FIG. 2, the side walls 61 and 62 may respectively carry pallet-like permanent magnets 26, 27 whose magnetic axes are aligned with or closely parallel to axis 13. The arrows in FIG. 2 show the direction of magnetic blowing. This blowing as resulting from the permanent magnets may be supplemented (or replaced by ) the magentic blowing resulting from the contour of the current path including here particularly the current flow through the contacts, the outer legs and the stem portion of the E of carrier 16. Since the direction of current flow is predetermined, one obtains a particularly directed magnetic field, which provides or augments magnetic blowing.

I claim:

1. In a power relay with twin contact making facilities for energized as well as unenergized relay, there being a first pair of stationary contacts for contact making when the relay is energized and a second pair of stationary contacts for contact making when the relay is de-energized, the relay including an armature and a core/coil structure for attracting the armature upon energization of the core/coil structure, the improvement comprising:

a first pair of contacts on the armature and being spaced along a first line which extends at right angles to the direction of movement of the armature upon energization of the core/coil structure, said first pair of stationary contacts being arranged respectively for contact making with the contacts of the first pair of contacts on the armature;

a second pair of contacts on the armature being arranged in a plane different from any plane through the first line, and at right angles to the direction of armature movement, and on a side of the first line opposite said first pair of stationary contacts, said second pair contacts being spaced along a second line which does not intersect but extends at right angles to said first line when projected into a common plane, further extending at right angles to the direction of movement of the contacts of the second pair, said second pair of stationary contacts being arranged respectively for contact making with the contacts of the second pair of contacts on the armature; and the armature being disposed for pivot motion on an axis which extends parallel to the second line.

2. In a power relay as in claim 1, the second pair of contacts switching the heavier current.

3. In a relay as in claim 1 and including means for magnetically blowing any arc.

4. In a relay as in claim 1, there being separate contact carriers and bridges for the contacts of the first pair on the armature and the contacts of the second pair on the armature.

5. In a relay as in claim 4, the bridges being insulated from each other.

6. In a relay as in claim 4, wherein one of the bridges has the configuration of an E with three legs accordingly and of which the center leg is resiliently mounted to the armature, the two outer legs carrying the contacts of the second pair.

7. In a relay as in claim 6, wherein insulative partitions are provided to extend in-between the legs of the E.

8. In a relay as in claim 1, having a housing, and partitions in the housing made of insulating material and extending between each of the contacts of the second pairs, and the contacts of the first pairs, laterally displaced from and shielding insulatively contacts paths as between the contacts of the second pairs.

9. In a power relay with twin-contact making facilities for energized as well as unenergized relay, there being a first pair of stationary contacts for contact making when the relay is energized and a second pair of stationary contacts for contact making when the relay is de-energized, the relay including an armature and a core/coil structure for attracting the armature upon energization of the core/coil structure, the improvement comprising:

means for hinging the armature along a hinge axis;

a first pair of contacts on the armature and being spaced along a first axis extending transversely to said hinge axis, said first pair of stationary contacts being arranged respectively for contact making with the contacts of the first pair of contacts on the armature;

a second pair of contacts on the armature underneath said first pair of stationary contacts and being spaced along a second axis extending parallel to said hinge axis, said second pair of stationary contacts being arranged respectively for contact making with the contacts of the second pair of contacts on the armature; and said axes do not intersect, but upon projection of the first axis into a plane through the second axis, the projection intersecting the second axis in a point between the contact of the second pair, and upon projecting of the second axis into a plane through the first axis, the latter projection intersecting the first axis in a point between the contacts of the first pair.

10. In a relay as in claim 9, wherein the first pairs of contacts are normally closed, the second pairs of contacts are closed for energized relay.

11. In a power relay as in claim 9, and including insulative partitions extending alongside of the armature towards the hinge axis.

12. In a power relay with twin contact making facilities for energized as well as unenergized relay, there being a first pair of stationary contacts for contact making when the relay is energized and a second pair of stationary contacts for contact making when the relay is de-energized, the relay including an armature and a core/coil structure for attracting the armature upon energization of the core/coil structure, the improvement comprising:

a first pair of contacts on the armature and being spaced along a first line which extends at right angles to the direction of movement of the armature upon energization of the core/coil structure, said first pair of stationary contacts being arranged respectively for contact making with the contacts of the first pair of contacts on the armature; and a second pair of contacts on the armature and spaced along a second line which extends at right angles to said first line as well as at right angles to the direction of movement of the contacts of the second pair, said second pair of stationary contacts being arranged respectively for contact making with the contacts of the second pair of contacts on the armature; and said contacts being arranged so that upon projection of the first line into a plane of the second line, the projection intersecting the second line between the contacts of the second pair, and upon projection of the second line into a plane through the first line, the latter projection intersecting the first line in a point between the contacts of the first pair.

13. In a relay as in claim 12, having a housing and partitions in the houing made of insulating material and extending between each of the contacts of the second pairs, and the contacts of the first pairs, laterally displaced from and shielding insulatively contacts paths as between the contacts of the second pairs.

* * * * *